US009633529B2

(12) United States Patent
You

(10) Patent No.: US 9,633,529 B2
(45) **Date of Patent: *Apr. 25, 2017**

(54) MEDIUM PICK-UP APPARATUS, MEDIUM PROCESS APPARATUS AND FINANCIAL DEVICE

(71) Applicant: LG CNS CO., LTD., Seoul (KR)

(72) Inventor: Jin Oh You, Gwangju (KR)

(73) Assignee: LG CNS CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/193,787

(22) Filed: Feb. 28, 2014

(65) Prior Publication Data

US 2014/0238814 A1 Aug. 28, 2014

(30) Foreign Application Priority Data

Feb. 28, 2013 (KR) ..... 10-2013-0022239

(51) Int. Cl.
*G07F 7/04* (2006.01)
*G07F 19/00* (2006.01)
(Continued)

(52) U.S. Cl.
CPC ..... *G07F 19/20* (2013.01); *B65H 1/04* (2013.01); *B65H 3/06* (2013.01); *B65H 3/063* (2013.01); *B65H 3/0607* (2013.01); *B65H 3/0684* (2013.01); *B65H 3/44* (2013.01); *G07D 11/0006* (2013.01); *G07D 11/0012* (2013.01);
(Continued)

(58) Field of Classification Search
CPC ..... G07D 11/0003; G07D 11/0012; G07D 11/0021; G07D 11/0024; B65H 2701/1912; B65H 2301/4314; B65H 2405/111; B65H 2405/332; B65H 1/04; B65H 3/06; B65H 3/0607; B65H 3/063; B65H 3/0684; B65H 3/44; G07F 19/20; G07F 7/04
USPC ..... 271/118, 126, 157–159, 900; 194/206, 194/207; 209/534
See application file for complete search history.

(56) References Cited

U.S. PATENT DOCUMENTS 4,959,405 A 9/1990 Briggs et al.
4,972,235 A * 11/1990 Iwamoto ..... G03G 15/04 399/370
(Continued)

FOREIGN PATENT DOCUMENTS

JP H07137870 A 5/1995
JP 2007-022753 A 2/2007
(Continued)

OTHER PUBLICATIONS

Office Action dated Feb. 28, 2014 in Korean Application No. 10-2013-0022239, filed Feb. 28, 2013.

*Primary Examiner* — Jeffrey Shapiro
(74) *Attorney, Agent, or Firm* — Saliwanchik, Lloyd & Eisenschenk

(57) ABSTRACT

Provided is a pick-up apparatus. The medium pick-up apparatus comprise a support plate to support a medium, a pick-up roller unit comprising a pick-up roller for picking up the medium, a detection unit to detect the number of medium that is picked up by the pick-up roller, and a pick-up roller moving device to move the pick-up roller unit to space the pick-up roller unit from the medium supported by the support plate when the pick-up of predetermined number of medium is detected by the detection unit.

19 Claims, 10 Drawing Sheets

(51) Int. Cl.

| | |
|---|---|
| ***B65H 3/06*** | (2006.01) |
| ***B65H 1/04*** | (2006.01) |
| ***G07D 11/00*** | (2006.01) |
| ***B65H 3/44*** | (2006.01) |

(52) U.S. Cl.
CPC ..... *G07D 11/0021* (2013.01); *G07D 11/0024* (2013.01); *B65H 2405/111* (2013.01); *B65H 2405/332* (2013.01); *B65H 2701/1912* (2013.01)

(56) References Cited

U.S. PATENT DOCUMENTS 5,451,039 A * 9/1995 Adachi ..... 271/9.06
5,882,002 A * 3/1999 Kamei ..... G03G 15/6511 271/118
6,015,147 A * 1/2000 Kimura et al. ..... 271/163
9,346,639 B2 * 5/2016 Kim ..... B65H 3/06
2001/0017440 A1 * 8/2001 Minamishin et al. ..... 271/10.11
2005/0073087 A1 * 4/2005 Kadowaki ..... B65H 3/0684 271/118
2005/0104273 A1 * 5/2005 Kim ..... B65H 3/0684 271/10.01
2006/0038338 A1 * 2/2006 Lin ..... 271/10.04
2007/0045933 A1 * 3/2007 Okazaki ..... H04N 1/0057 271/104
2008/0001352 A1 * 1/2008 Jeong ..... B65H 3/06 271/306
2010/0021187 A1 * 1/2010 Zhang ..... B65H 3/0684 399/23
2011/0024969 A1 * 2/2011 Matsushima ..... B65H 3/0669 271/10.11
2012/0008997 A1 * 1/2012 Takata ..... B65H 3/0669 399/388

FOREIGN PATENT DOCUMENTS

KR 10-1988-0000894 A 3/1988
KR 10-2007-0105932 A 10/2007

* cited by examiner

MEDIUM PICK-UP APPARATUS, MEDIUM PROCESS APPARATUS AND FINANCIAL DEVICE

CROSS-REFERENCE TO RELATED APPLICATION

This application claims the benefit under 35 U.S.C. §119 of Korean Patent Application No. 10-2013-0022239, filed Feb. 28, 2013, which is hereby incorporated by reference in its entirety.

BACKGROUND

The present disclosure relates to a medium pick-up apparatus, a medium processing apparatus, and a financial device.

Generally, financial devices are devices that process financial business that is desired by a customer. The financial devices deposit or withdraw a medium or automatically transfer the medium.

The financial device comprises a medium storage box for storing a medium. The medium storage box may have one medium storage space or a plurality of medium storage spaces.

In case of the medium storage box having the plurality of medium storage spaces, a transfer unit for depositing and withdrawing a medium may be provided with the same number as the medium storage spaces. The transfer unit comprises a feed roller and gate roller for depositing a medium, a pick-up roller for picking up the medium to withdraw the medium, and a driving part for driving the feed roller and/or the pick-up roller.

Thus, in the case of the medium storage box, since the transfer unit having the same number as the medium storage space is provided, the medium storage space within the medium storage box may be reduced in size. In addition, the medium storage box may be complicated in structure, and thus, manufacturing costs of the financial device may increase.

In the medium storage box according to the related art, if a sensor senses that a predetermined number of media are picked up, an operation of the pick-up roller may be stopped. However, even though the operation of the pick-up roller is stopped, the pick-up roller may rotate at a predetermined angle by an inertia effect. When the pick-up roller rotates at the predetermined angle, the medium that does not have to be picked up may be picked up to cause a defect in which the medium is jammed between the feed roller and the gate roller. In this case, a back feeding (that is an operation in which the feed roller rotates in a direction opposite to the rotation direction of the feed roller when the medium is withdrawn) may be performed to move the medium, which is jammed between the feed roller and the gate roller, again into the medium storage space. Also, even though the back feeding is performed, in some cases, the back feeding may not be normally performed or may interfere with a medium to be picked up in the following process to cause a pick-up obstacle of the medium.

BRIEF SUMMARY

Embodiments provide a medium pick-up apparatus, a medium processing apparatus, and a financial device.

In one embodiment, a medium pick-up apparatus comprises: a support plate to support a medium; a pick-up roller unit comprising a pick-up roller for picking up the medium; a detection unit to detect the number of medium that is picked up by the pick-up roller; and a pick-up roller moving device to move the pick-up roller unit to space the pick-up roller unit from the medium supported by the support plate when the pick-up of predetermined number of medium is detected by the detection unit.

In another embodiment, a medium processing apparatus comprises: a medium depositing and withdrawing unit through which a medium is deposited or withdrawn; a medium storage box to store the medium that is deposited or withdrawn; and a detection unit to detect the medium that is deposited or withdrawn, wherein at least one of the medium depositing and withdrawing unit and the medium storage box comprises: a pick-up roller for picking up the medium stacked in a medium storage space; and a pick-up roller moving device to move the pick-up roller in a direction away from remaining medium in the medium storage space when predetermined number of medium are withdrawn from the medium storage space.

In further another embodiment, a financial device comprises: a customer information acquisition unit to acquire customer information; a user interface to display a menu and information for depositing or withdrawing, the user interface inputting or selecting a command or information for depositing or withdrawing; and a medium processing apparatus that stores a medium deposited by a customer to deposit the deposited medium and withdraws stored medium to the customer to withdraw the withdrawn medium, wherein, when the medium processing apparatus picks up a portion of media stacked in a medium storage space by using a pick-up roller to withdraw the picked medium from the medium storage space, the pick-up roller is spaced apart from remaining media of the media stacked in the medium storage space after the portion of the media is withdrawn from the medium storage space.

The details of one or more embodiments are set forth in the accompanying drawings and the description below. Other features will be apparent from the description and drawings, and from the claims.

DETAILED DESCRIPTION

Figure 1:
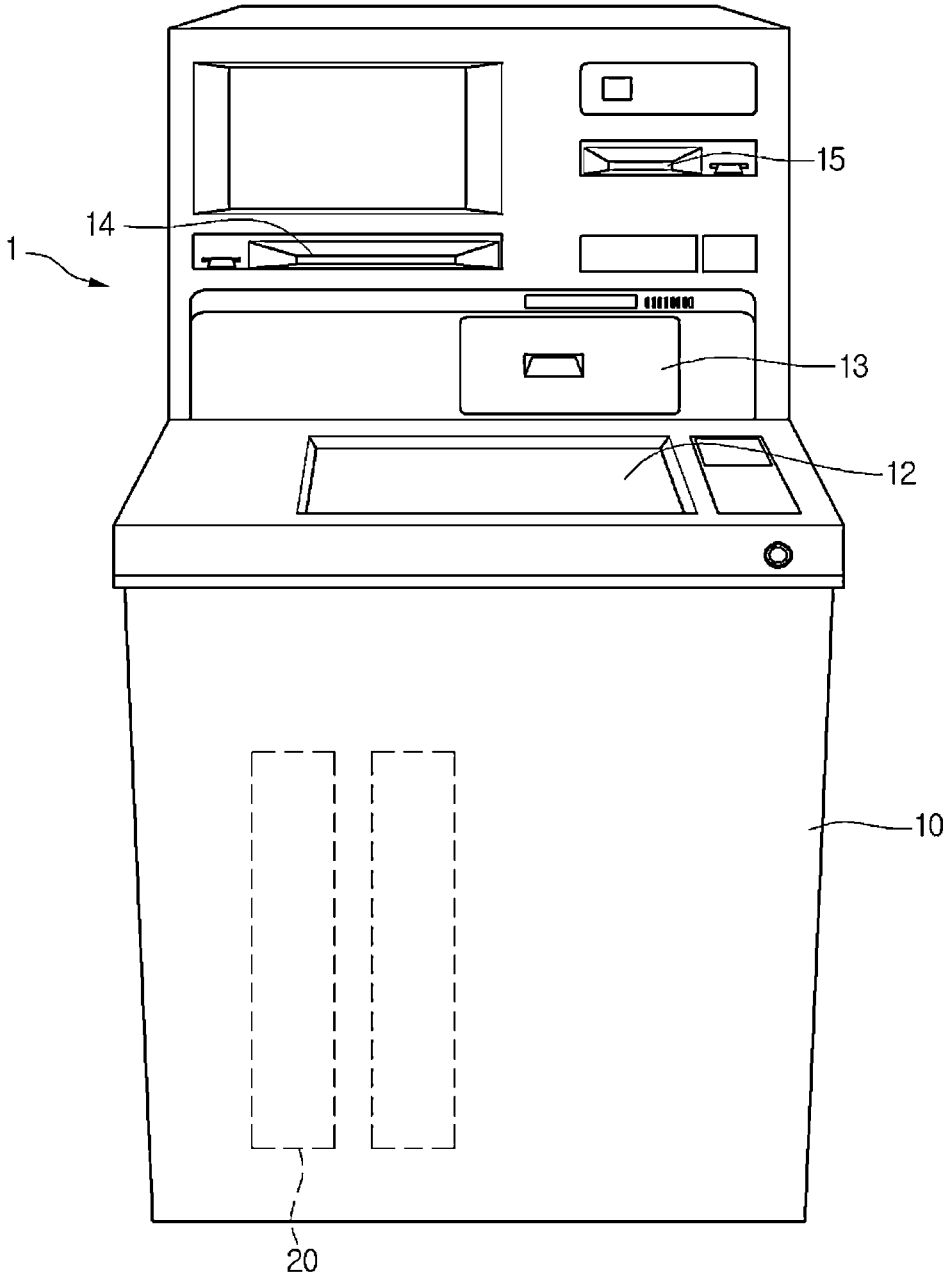
FIG. 1 is a perspective view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view of a financial device according to an embodiment.

Referring to FIG. 1, a financial device 1 according to an embodiment comprises a main body 10 in which a plurality of parts are built. The main body 10 comprises a medium depositing and withdrawing unit 13 for inserting or withdrawing a medium and at least one medium storage box 20 for storing the medium. The at least one medium storage box 20 may be separably mounted on the main body 10.

The medium depositing and withdrawing unit 13 has a medium receiving space that is accessible by a customer. The medium receiving space may be opened or closed by a covering member such as a shutter or cover. In some cases, the receiving space may be maintained in an opened state.

Also, according to a kind of financial device 1, the main body 10 may further comprise a bankbook entrance part 14 for inserting or withdrawing a bankbook and a card entrance part 15 for inserting or withdrawing a card. In the current embodiment, the bankbook entrance part 14 or the card entrance part 15 may be called a customer information acquisition unit for acquiring customer's information. The present disclosure is not limited to a kind of customer information acquisition unit. For example, the customer information acquisition unit may acquire information recorded in an RFID tag or USB or acquire customer's information by using customer's fingerprint.

Also, the financial device 1 may further comprise a user interface 12 for displaying a menu and information for depositing or withdrawing a medium or inputting or selecting a command or information for depositing or withdrawing the medium.

Hereinafter, the medium storage box 20 will be described in detail.

Figure 2:
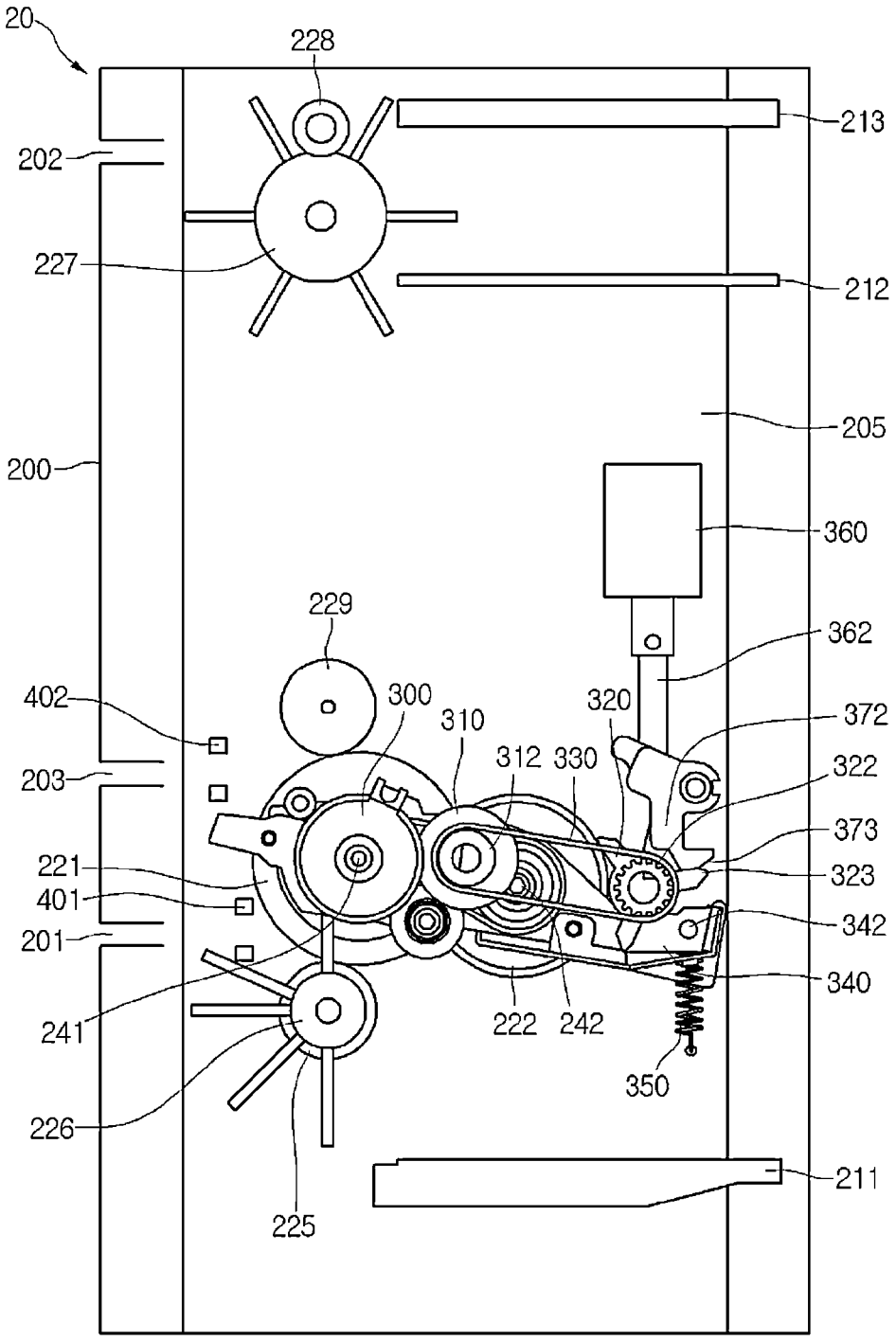
FIG. 2 is a schematic view illustrating an inner surface of a medium storage box according to an embodiment.
Figure 3:
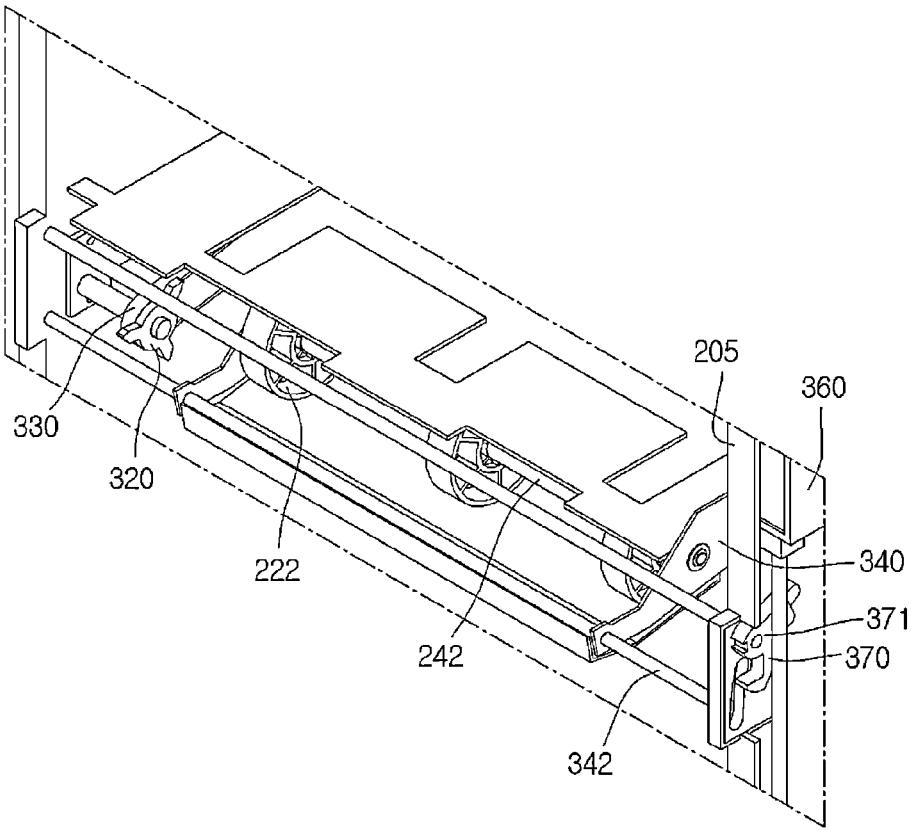
FIG. 3 is a perspective view of a state in which a pick-up roller is connected to a connection member according to an embodiment.
Figure 4:
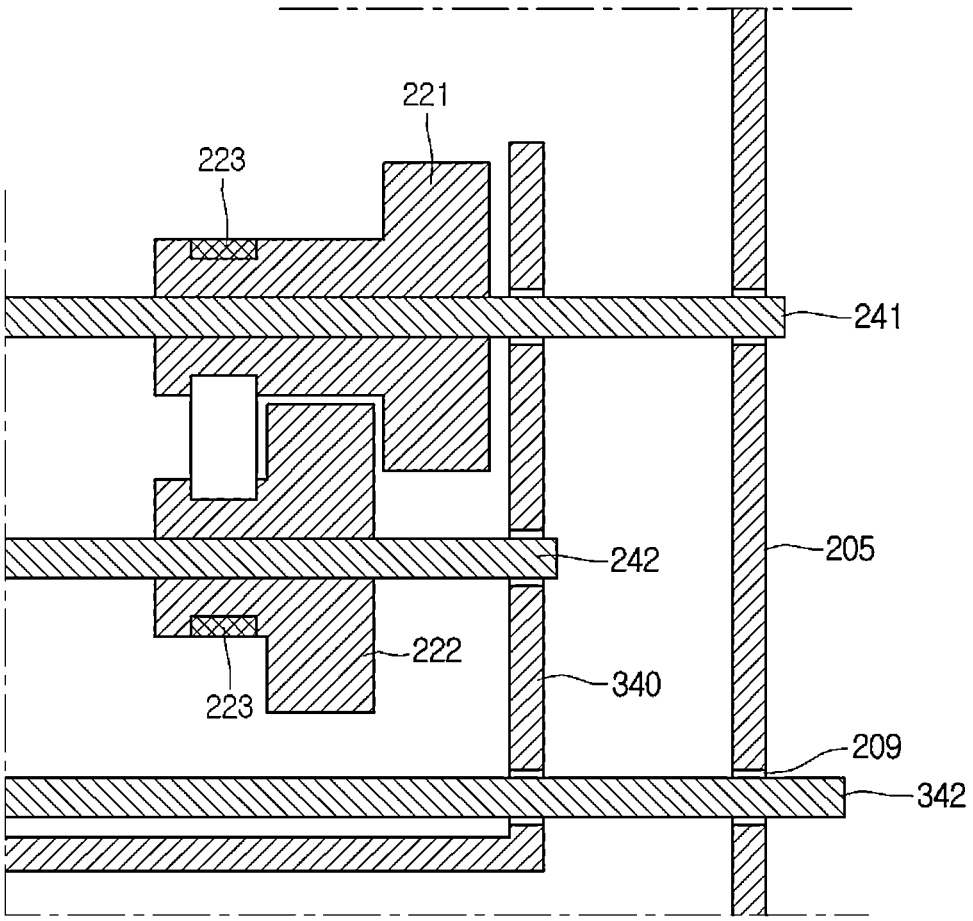
FIG. 4 is a cross-sectional view illustrating a connection relationship between a feed roller and the pick-up roller according to an embodiment.

FIG. 2 is a schematic view illustrating an inner surface of a medium storage box according to an embodiment, FIG. 3 is a perspective view of a state in which a pick-up roller is connected to a connection member according to an embodiment, and FIG. 4 is a cross-sectional view illustrating a connection relationship between a feed roller and the pick-up roller according to an embodiment.

Referring to FIGS. 2 to 4, the medium storage box 20 according to the current embodiment comprises a housing 200 defining an exterior thereof.

The housing 200 may comprise a first passage 201 through which a first medium is deposited or withdrawn, a second passage 202 through which a second medium is deposited, and a third passage 203 through which the second medium is withdrawn. The first medium may be deposited or withdrawn through the first passage 201. On the other hand, the second medium may be deposited through the second passage 202 and withdrawn through the third passage 203.

Also, the housing 200 may comprise a first support plate 211 for supporting the first medium and a second support plate 212 for supporting the second medium. Thus, in the current embodiment, a plurality of medium storage spaces for storing the media are partitioned in the medium storage box 20.

Here, the same kind of media or different kinds of media may be stored in the plurality of medium storage spaces. Alternatively, media different from each other may be stored in the plurality of medium storage spaces. For example, a medium that is determined as a normal state by a discrimination part (not shown) may be stored in the first medium storage space, and a medium that is determined as an abnormal state by the discrimination part or a medium that is not received by the customer may be stored in the second medium storage space. The current embodiment is not limited to kind and state of medium stored in each of the storage spaces.

The second support plate 212 is disposed above the first support plate 211. That is, the first and second support plates 211 and 212 may be vertically disposed. However, the first and second support plates 211 and 212 may be horizontally disposed. When the first and second support plates 211 and 212 are vertically disposed, the third passage 203 may be defined above the first passage 201, and the second passage 202 may be defined above the third passage 203. That is, the third passage 203 may be defined between the first passage 201 and the second passage 202.

Each of the first and second support plates 211 and 212 may vertically move within the medium storage box 20 by an independent driving part.

The medium storage box 20 comprises a first feed roller 221 and first gate roller 225 for inserting the first medium and a pick-up roller 222 for selectively picking up the first or second medium to withdraw the stored first or second medium.

For example, the first gate roller 225 may receive a rotation force from the first feed roller 221 to rotate in a direction opposite to that of the first feeder roller 221. In the current embodiment, since the rotation of the first feed roller 221 and the first gate roller 225 may be realized by the well-known structure, their detailed descriptions will be omitted.

The pick-up roller 222 and the first feed roller 221 may be connected to each other by a belt 223. For another example, the pick-up roller 222 and the first feed roller 221 may be driven by a separate driving part.

The pick-up roller 222 may be disposed between the first support plate and the second support plate 212 so that the pick-up roller 222 selectively picks up the first or second medium.

A separation roller 226 for striking the first medium to easily drop down may be connected to a rotation shaft of the first gate roller 225.

Also, the medium storage box 20 may further comprise a first detection unit 401 for detecting the number of first medium that is deposited or withdrawn (or picked up by the pick-up roller). For example, the first detection unit 401 may comprise a light emitting sensor and a light receiving sensor. For example, in the current embodiment, it may be determined that the medium is not detected when light emitted from the light emitting sensor does not reach the light receiving sensor. The current embodiment is not limited to a kind of first detection unit 401 and a method for detecting the medium.

The medium storage box 20 may further comprise a second feed roller 227 and second gate roller 228 for inserting the second medium, a third gate roller 229 for withdrawing the second medium together wither the first feed roller 221, and a pressing plate 213 for pressing the second medium when the second medium is withdrawn.

For example, the second feed roller 227 may rotate by receiving a rotation force from the first feed roller 221 or rotate by a separate driving part that is different from the driving part of the first feed roller 221. Also, the second gate roller 228 may rotate in a direction opposite to that of the second feed roller 227 by receiving a rotation force from the second feed roller 227 or rotate by a frictional force with the second medium that is deposited.

The pressing plate 213 may be disposed above the second support plate 212. The pressing plate 213 may press the second medium stored on the second support plate 212 toward the pick-up roller 223 when the second medium is withdrawn. The pressing plate 213 may vertically move by a separate driving part that is different from the driving part for driving the second support plate 212.

Also, the medium storage box 20 may further comprise a second detection unit 402 for detecting the number of second medium that is withdrawn (or the number of second medium that is picked up by the pick-up roller). The second detection unit 402 may be equal to or different from the first detection unit 401. The current embodiment is not limited to a kind of second detection unit 402 and a method for detecting the medium.

Referring to FIGS. 3 and 4, a first rotation shaft of the first feed roller 221 and a second rotation shaft 242 of the pick-up roller 222 may pass through the connection member 340. Also, the second rotation shaft 241 of the first feed roller 221 may pass through a frame 205 provided in the housing 200.

A hook part 342 is disposed on the connection member 340. The hook part 342 may be disposed parallel to the second rotation shaft 242 of the pick-up roller 222 to pass through the frame 205. A hook hole 209 through which the hook part 342 passes may be defined in the frame 205. In the current embodiment, the hook part 342 may be a protrusion that protrudes from the connection member 340 or a shaft that is coupled to the connection member 340. The current embodiment is not limited to a shape of the hook part 342.

The connection member 340 may rotate with respect to the first rotation shaft 241. To allow the connection member 240 to rotate with respect to the first rotation shaft 241, the hook hole 209 may have an arc shape so that the hook part 342 is movable. Also, one end of an elastic member 350 may be connected to the hook part 342, and the other end of the elastic member 350 may be connected to the frame 205. The elastic member 350 may provide an elastic force, which pulls the hook part downward, to the hook part 342.

When the connection member 340 rotates with respect to the first rotation shaft 241, the second rotation shaft 242 connected to the connection member 340 may rotate together with the connection member 340. That is, the second rotation shaft 242 may have a variable height.

In FIG. 2, to withdraw the second medium, the second support part 212 may move downward toward the pick-up roller 222. However, in this state, since the second rotation shaft 242 is lower than the first rotation shaft 241 with respect to a bottom surface of the housing 200, even though the second support part 212 descends, the pick-up roller 222 may not contact the second medium that is disposed on the second support part 212. Thus, to pick up the second medium, the second rotation shaft 242 of the pick-up roller 222 may move by a pick-up roller moving device.

Particularly, the pick-up roller moving device may comprise a clutch 300 connected to the first rotation shaft 241 and a power transmission connected to the clutch 300 to receive a rotation force of the first rotation shaft 241, thereby transmitting the rotation force to the hook part 342 of the connection member 340.

For example, the clutch 300 may be an electric clutch. When the clutch 300 is turned on, the clutch 300 may transmit a power of the first rotation shaft 241 to the power transmission.

The power transmission may comprise a transmission gear connected to the clutch 300 and a rotating lever 320 connected to the transmission gear 310 by a transmission belt 330. Pulleys 312 and 322 around which the transmission belt 330 is surrounded may be provided on the transmission gear 310 and the rotating lever 320, respectively. Also, a plurality of protrusions 323 may be radially disposed around the rotating lever 320. The plurality of protrusions 323 may be spaced a predetermined angle from each other with respect to a rotational center axis of the rotating lever 320. Although the plurality of protrusions 323 are disposed at an angle of about 120 degrees with respect to the rotational center of the rotating lever 320 in FIG. 2, the number of protrusions 323 and an arranged angle of the protrusions 323 may be different according to a ascending height of the hook part 342 in the current embodiment.

One of the plurality of protrusions 323 of the rotating lever 320 may selectively contact the hook part 342 while the rotating lever 320 rotates. After the protrusion 323 contacts the hook part 342, the hook part 342 may be lifted.

The hook part 342 that is lifted by the rotating lever 320 may be fixed in position by a position fixing unit 370. The position fixing unit 370 may be rotatably connected to the frame 205 by the rotation shaft 371. The position fixing unit 370 may comprise a hook 372 to which the hook part 342 is hooked. A guide surface 373 for easily lifting the hook part 342 along the hook 372 may be disposed on a lower portion of the hook 372. The guide surface 373 may be an inclined surface.

The position fixing unit 370 may be connected to an elastic member (not shown). The elastic member may provide an elastic force to the hook 372 of the position fixing unit 370 so that the hook 372 rotates in a direction in which the hook part 342 is hooked.

The position fixing unit 370 may further comprise an extension part 374. A driving part 360 for operating the position fixing unit 370 may be connected to the extension part 374. For example, the driving part 360 may be a solenoid and comprise an operation bar 362 that is capable of translational motion. Although not shown, the operation bar 362 may be connected to the extension part 374 by a pin. Here, a groove or hole defined in the extension part 374 and connected to the pin may have an arc shape to inhibit the rotation force from being transmitted into the pin when the position fixing unit 370 rotates at a predetermined angle in one direction. On the other hand, the driving part 360 may be a motor. The present disclosure is not limited to a kind of driving part 360.

Hereinafter, a process for inserting or withdrawing first and second media will be described.

Figure 5:
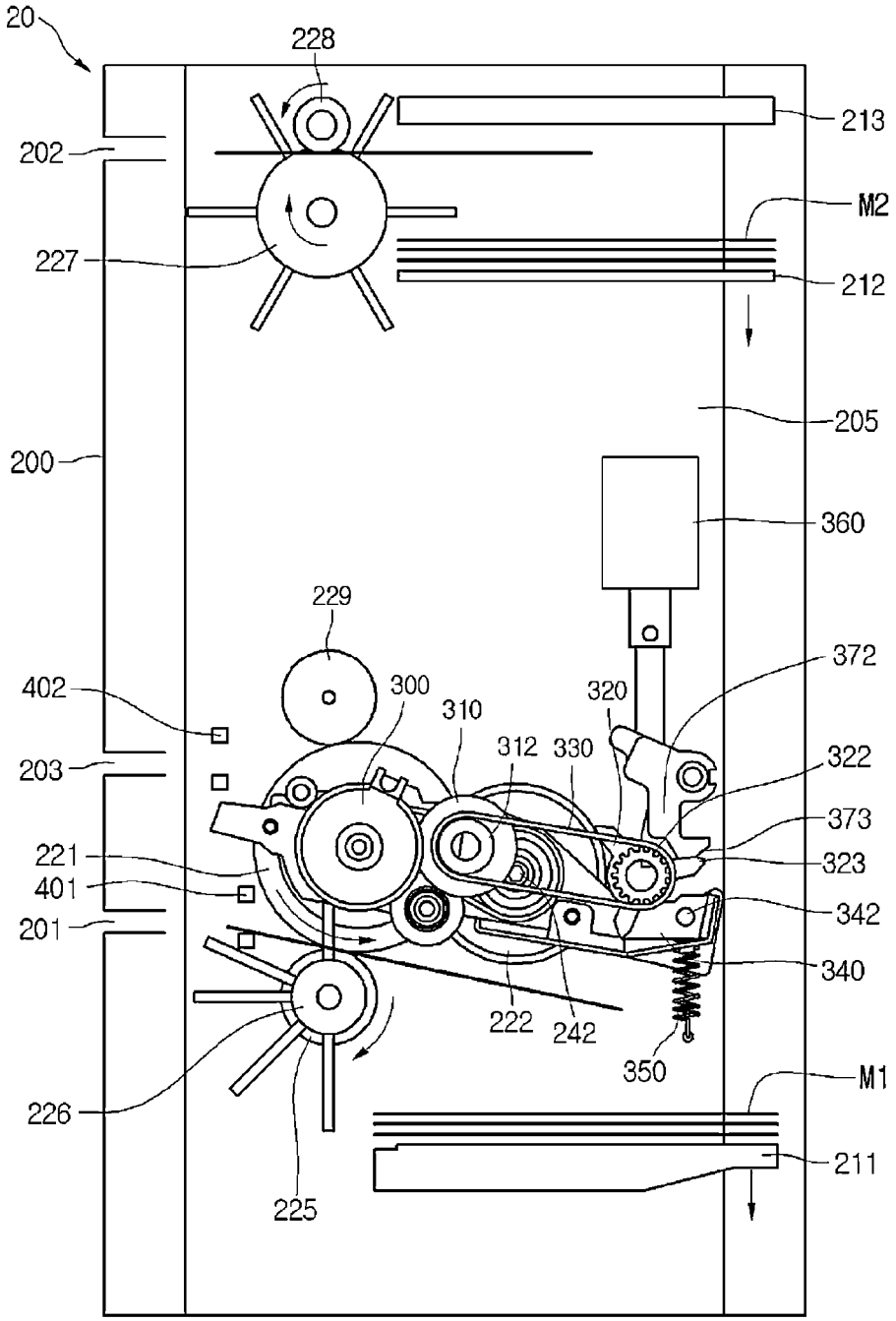
FIG. 5 is a view of a process in which first and second media are deposited according to an embodiment.

FIG. 5 is a view of a process in which first and second media are deposited according to an embodiment.

Although the first and second media are deposited into the medium storage box at the same time in FIG. 5, one of the first and second media may be deposited, and then, the other one may be deposited.

Referring to FIG. 5, a first medium M1 may be deposited into the housing 200 through the first passage 210. The first medium M1 deposited into the housing 200 may drop onto the first support plate 211 by the first feed roller 221 and the first gate roller 225. Here, the first feed roller 221 rotates in a counterclockwise direction in FIG. 5, and the first gate roller 225 rotates in a clockwise direction. Also, if the number of first medium M1 that is deposited increases, the first support plate 211 descends.

A second medium M2 is deposited into the housing 200 through the second passage 202. The second medium M2 deposited into the housing 200 may drop onto the second support plate 212 by the second feed roller 227 and the second gate roller 228. Here, the second feed roller 221 rotates in the clockwise direction in FIG. 5, and the first gate roller 225 rotates in the counterclockwise direction. Also, if the number of second medium M2 that is deposited increases, the second support plate 212 descends.

As illustrated in FIG. 5, while the first medium M1 is deposited into the medium storage box, the clutch 300 may be turned off, and thus, the rotation force of the first rotation shaft 241 may not be transmitted into the transmission gear 310.

Figure 6:
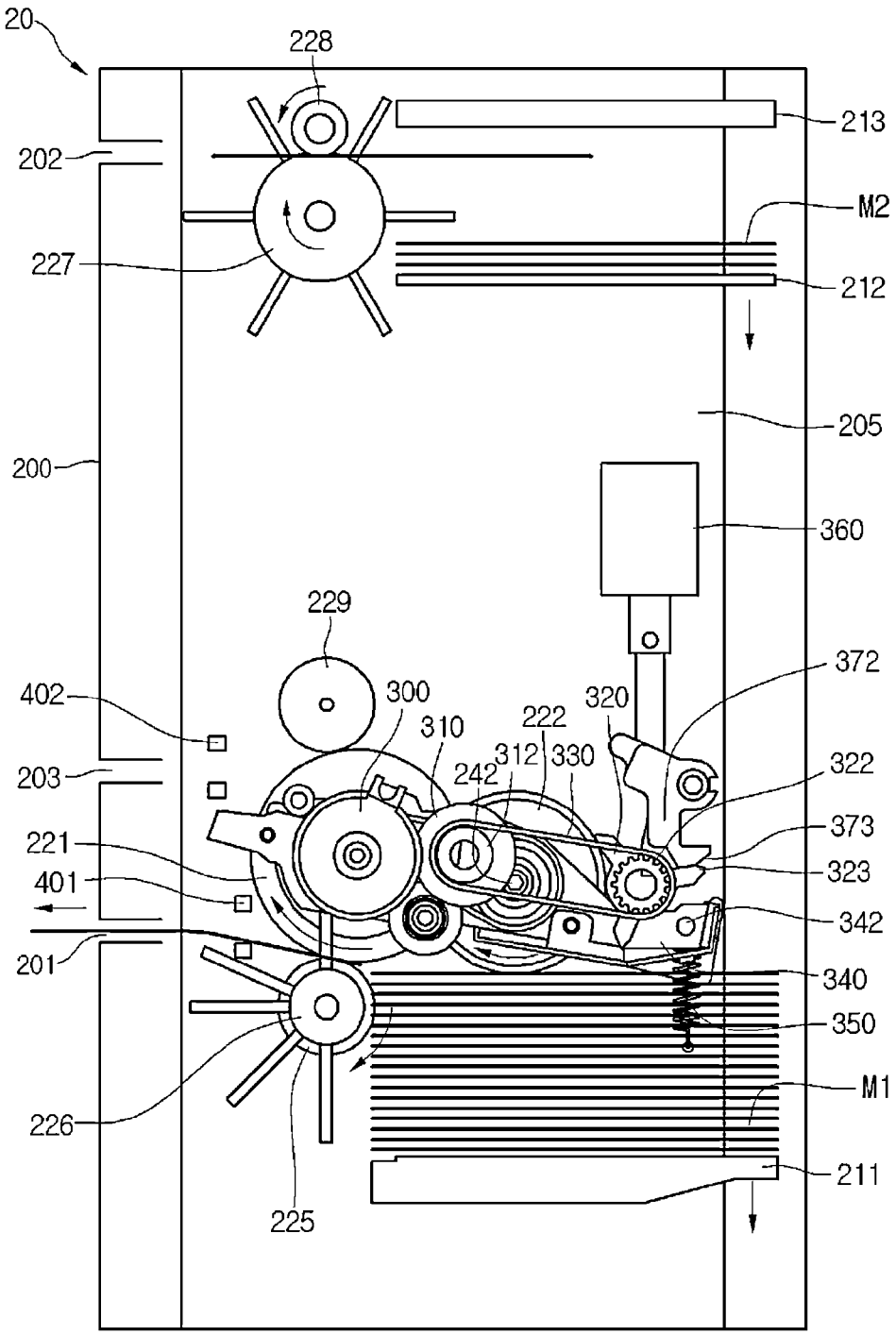
FIG. 6 is a view of a process in which the first medium is withdrawn, and the second medium is deposited according to an embodiment.

FIG. 6 is a view of a process in which the first medium is withdrawn, and the second medium is deposited according to an embodiment.

Although the second medium is deposited while the first medium is withdrawn in FIG. 6, one of the insertion of the first medium and the withdrawal of the second medium may be performed, and then, the other one may be performed. Since the insertion process of the second medium in FIG. 6 is equal to that in FIG. 5, its description will be omitted.

Referring to FIG. 6, to withdraw the stored first medium M1, the first support plate 211 descends. The first support plate 211 may ascend until the first medium M1 placed on the first support plate 211 contacts the pick-up roller 222. Then, the first medium M1 placed on the first support plate 211 may be picked up one sheet at a time by the pick-up roller 222. The first medium M1 that is picked up may be withdrawn to the outside of the housing 200 through the first passage 201. Here, the pick-up roller 222 and the first feed roller 221 rotate in the clockwise direction (a first direction) in FIG. 6. When the first medium is withdrawn, the second rotation shaft 242 is lower than the first rotation shaft 241.

When the first medium M1 is withdrawn, the clutch 300 may be maintained in a turn-off state. Thus, the rotation force of the first rotation shaft 241 may not be transmitted into the transmission gear 310.

While the first medium M1 is withdrawn, the number of withdrawn first medium M1 (or the number of first medium M1 that is picked up) may be detected by the first detection unit 401. When the withdrawal of the predetermined number of first medium that has to be withdrawn is detected by the first detection unit 401, a control part (not shown) may turn the clutch 300 on.

Thus, the power of the first rotation shaft 241 may be transmitted into the transmission gear 310. Then, the transmission gear 310 rotates in the counterclockwise direction, and the transmission belt 330 rotates in the counterclockwise direction. Thus, the rotating lever 320 rotates in the counterclockwise direction.

While the rotating lever 320 rotates in the counterclockwise direction, when one of the plurality of protrusions 323 contacts the hook part 342 of the connection member 340, the protrusion 323 lifts the hook part 342. When the hook part 342 is lifted, the connection member 340 may rotate in the counterclockwise direction with respect to the first rotation shaft 241, and the second rotation shaft 242 of the pick-up roller 222 may ascend together with the hook part 342 by the rotation of the connection member 340. Also, the hook part 342 is hooked on the position fixing unit 370. A process in which the hook part 342 is hooked on the position fixing unit 370 will be described in detail with reference to FIGS. 7 to 9. Also, when the hook part 342 is hooked on the position fixing unit 370, the rotation of the first rotation shaft 241 of the first feed roller 221 may be stopped.

That is, in the current embodiment, when the withdrawal of the predetermined number of first medium M1 that has to be withdrawn is detected by the first detection unit 401 to turn the clutch 300 on, the pick-up roller 222 may move upward to space the pick-up roller 222 from the first medium M1 placed on the first support part 211.

Thus, a defect in which the first medium that should not be withdrawn is picked up and jammed between the first feed roller 221 and the first gate roller 225 after the predetermined number of first medium are withdrawn may be solved.

According to the related art, when the operation of the driving part for rotating the pick-up roller is stopped after the predetermined number of first medium are withdrawn, a defect in which the first medium that should not be withdrawn is picked up by rotational inertia of the pick-up roller and jammed between the first feed roller 221 and the first gate roller 225 may occur.

However, according to the present invention, since the operation of the pick-up roller 222 is stopped, and the clutch 300 is turned on after the predetermined number of first medium are withdrawn to space the pick-up roller 222 from the first medium, event though the pick-up roller 222 rotates by the inertial force, the pick-up roller 222 may not pick up the first medium M1.

In the current embodiment, the pick-up roller 222 may be spaced from the first medium at the same time when the rotation of the pick-up roller 222 is stopped or be spaced from the first medium within a predetermined time after the rotation of the pick-up roller 222 is stopped. Here, the predetermined time may be within a time range in which a remaining first medium placed on the first support plate is not picked up when the pick-up roller rotates by the inertial force even though the power transmitted into the pick-up roller 222 is blocked. Although the power of the first rotation shaft 241 is transmitted into the pick-up roller 222 as described above, even though the pick-roller 222 rotates by a separate driving part, the same effect may be achieved. That is, when the operation of the pick-up roller 222 is stopped to turn the clutch 300 on after the predetermined number of first medium are withdrawn, even though the pick-up roller 222 rotates by the inertial force, since the pick-up roller 222 is spaced from the first medium M1, the pick-up of the first medium M1 by the pick-up roller 222 may be inhibited.

Also, in the above-described embodiment, although the operation of the pick-up roller 222 is stopped when the clutch 300 is turned on, and the hook part 342 is hooked on the position fixing unit 370, the present disclose is not limited thereto. For example, a timing at which the clutch 300 is turned on and a timing at which the operation of the pick-up roller 222 is stopped may substantially coincide with each other. In this case, even though the operation of the pick-up roller 222 is stopped, the pick-up roller 222 may further rotate for a predetermined time by the inertia. Thus, when the clutch 300 is turned on during or before the predetermined time, the hook part 342 may ascend and then be fixed to the position fixing unit. As a result, the pick-up roller 222 may be avoided from the first medium M1. Also, in this case, an inertia amount of pick-up roller 222 may be amount that is enough to secure a rotation amount for sufficiently fixing the hook part 342 to the position fixing unit 370.

Figure 7:
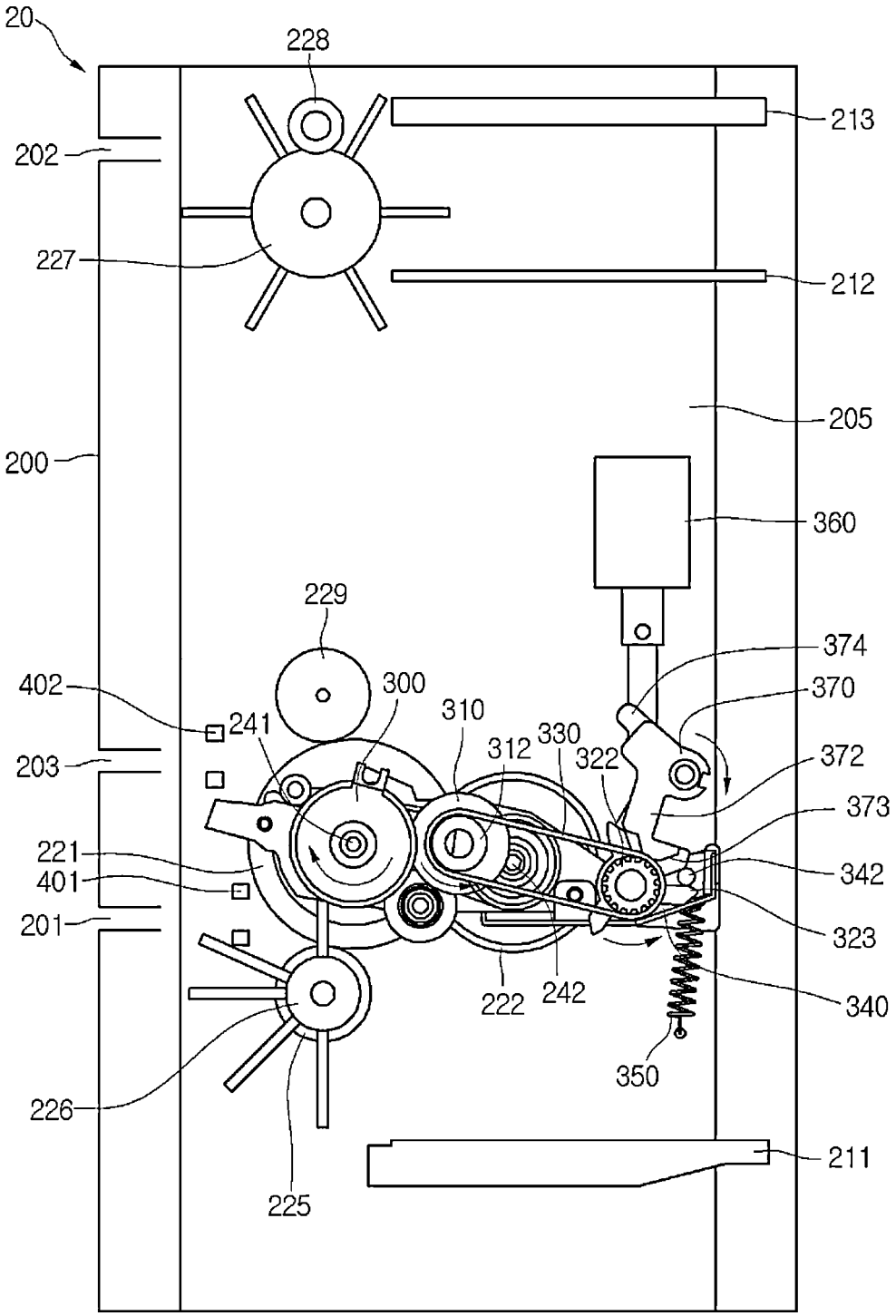
FIGS. 7 to 9 are views of a process in which the second medium is withdrawn according to an embodiment.
Figure 8:
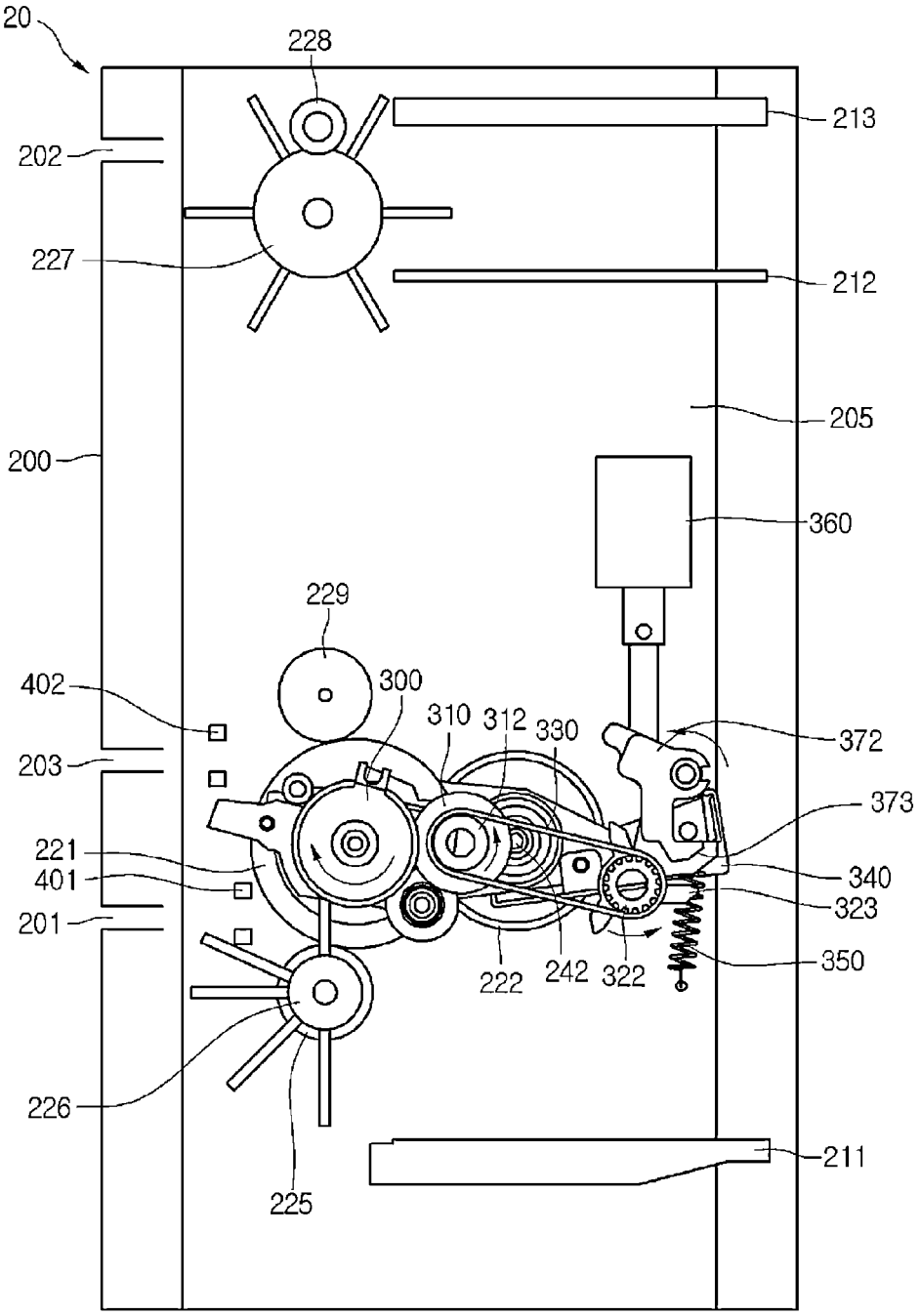
Figure 9:
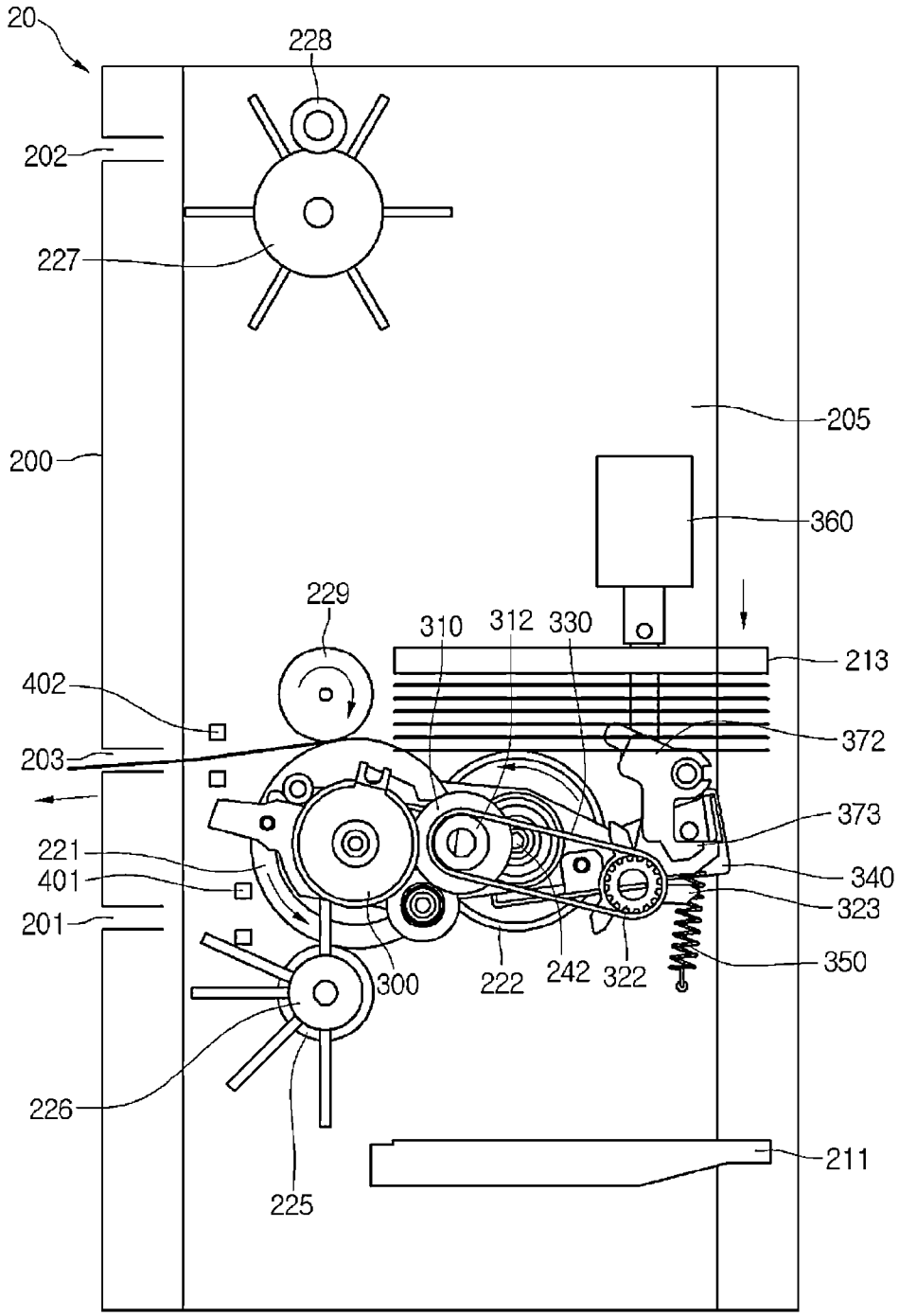
Figure 10:
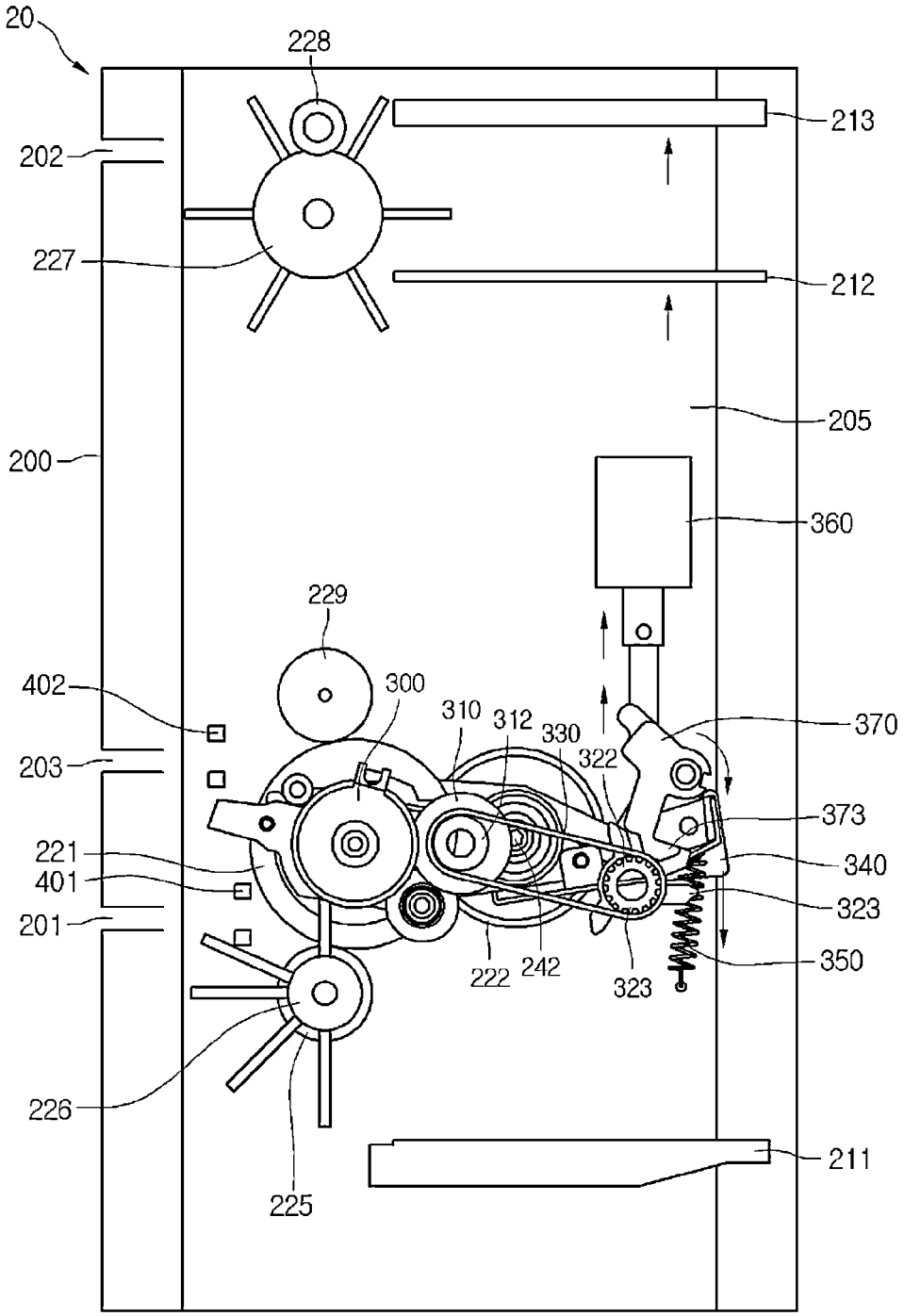
FIG. 10 is a view of a state in which a position fixing unit operates by a driving part after the second medium is completely withdrawn to allow a second rotation shaft of the pick-up roller to descend.

FIGS. 7 to 9 are views of a process in which the second medium is withdrawn according to an embodiment, and FIG. 10 is a view of a state in which a position fixing unit operates by a driving part after the second medium is completely withdrawn to allow a second rotation shaft of the pick-up roller to descend.

In FIG. 9, the second support plate is omitted.

Referring to FIG. 7, to withdraw the second medium M2, the first rotation shaft 241 of the first feed roller 221 rotates in the clockwise direction, and the clutch 300 is turned on.

When the clutch 300 is turned on, the rotation force of the first rotation shaft 241 is applied so that the transmission gear 310 rotates in the counterclockwise direction. When the transmission gear 310 rotates in the counterclockwise direction, the transmission belt 330 rotates in the counterclockwise direction. Thus, the rotating lever 320 rotates in the counterclockwise direction. While the rotating lever 320 rotates in the counterclockwise direction, when one of the plurality of protrusions 323 contacts the hook part 342 of the connection member 340, the protrusion 323 lifts the hook part 342. When the hook part 342 is lifted, the connection member 340 may rotate in the counterclockwise direction with respect to the first rotation shaft 241, and the second rotation shaft 242 of the pick-up roller 222 may ascend together with the hook part 342 by the rotation of the connection member 340.

Referring to FIG. 8, while the hook part 342 ascends, when the hook part 342 contacts the hook 372 of the position fixing unit 370, the hook 372 rotates in the clockwise direction. Then, when the hook part 342 ascend up to a predetermined height, the position fixing unit 370 rotates in the counterclockwise direction by the elastic member, and the hook part 342 is hooked on the hook 372.

After the hook part 342 is hooked on the hook 372, the rotation of the first feed roller 221 is stopped, and the clutch 300 is turned off.

As described above, in the state where the pick-up roller 222 ascends, the second support plate 212 moves toward the pick-up roller 222. In FIG. 9, the second support plate 212 descends toward the pick-up roller 222.

A hole (not shown) through which the pick-up roller 222 passes is defined in a position of the second support plate 212 that corresponds to the pick-up roller 222. Thus, when the second support plate 212 descends, the pick-up roller 222 may pass through the hole to contact the second medium M2. Thus, the second medium M2 may be picked up by the pick-up roller 222.

Here, to smoothly pick up the second medium M2 by the pick-up roller 222, the pressing plate 213 may descend to press the second medium M2 toward the pick-up roller 222.

Finally, the second medium M2 may be pick-up one by one by the pick-up roller 222, and the second medium M2 that is picked up may be withdrawn to the outside of the housing 200 through the third passage 203.

Here, the pick-up roller 222 and the first feed roller 221 may rotate in the counterclockwise direction (second direction) in FIG. 9, and the third gate roller 229 may rotate in the clockwise direction.

While the second medium M2 is withdrawn, the number of withdrawn second medium M2 (or the number of second medium M2 that is picked up) may be detected by the second detection unit 402. When the withdrawal of the predetermined number of first medium that has to be withdrawn are detected by the second detection unit 402, a control part (not shown) may turn the driving part for driving the first feed roller off and turn the driving part 360 for driving the position fixing unit 370 on.

Then, the operation bar 362 may move upward to allow the position fixing unit 370 to rotate in the clockwise direction. Then, the hooking between the hook 372 of the position fixing unit 370 and the hook part 342 may be released, and the hook part 342 may move downward by a restoring force of the elastic member 350. Then, the connection member 340 rotates in the clockwise direction with respect to the first rotation shaft 241, and the pick-up roller 222 returns to its original position as illustrated in FIG. 2.

As described above, after the predetermined number of second medium M2 are withdrawn, the driving part 360 may operate to release the hooking between the position fixing unit 370 and the hook part 342. Then, as the pick-up roller 222 moves downward, even though the pick-up roller 222 does not rotate by the inertial, since the pick-up roller 222 does not pick up the second medium M2, it may inhibit the second medium M2 from being jammed between the first feed roller 229 and the third gate roller 229.

According to the current embodiment, since the first or second medium is capable of being picked up by the single pick-up roller 222, it is unnecessary to provide an additional pick-up roller 222. Also, the medium storage capacity within the medium storage box may increase, and the medium storage box may be simplified in structure.

In this specification, the pick-up roller, the connection member, and the hook part may be commonly called a pick-up roller unit. Also, a position of the pick-up roller unit when the first medium is deposited or withdrawn may be called a first position, and a position of the pick-up roller unit when the second medium is withdrawn may be called a second position. Also, the pick-up roller moving device may change a position of the pick-up roller unit according to a kind of medium to be picked up.

Also, in this specification, the pick-up roller moving device may move the pick-up roller unit to pick up the second medium. Also, when the fixing between the position fixing unit and the pick-up roller unit is released, the pick-up roller unit may move downward by a self-weight thereof. On the other hand, the position fixing unit is not provided, and the pick-up roller unit may move in one direction by the pick-up roller moving device and then move (rotate) in the other direction.

Also, in two medium storage space of one medium storage box, although the media within two medium storage spaces are selectively picked up by using one pick-up roller, the current embodiment is not limited thereto. For example, the current embodiment may be applied to various devices that are capable of picking up the medium, regardless of the number of medium storage spaces or the number of pick-up rollers. For example, in a case where the medium within one medium storage space is picked up by one pick-up roller, if the pick-up roller moving device is provided, the case may be applied to the current embodiment. For example, the pick-up roller may be disposed under the support plate, and the pick-up roller may move downward by the pick-up roller moving device while the medium stacked on the support plate is picked up. Alternatively, the pick-up roller may be disposed above the support plate, and the pick-up roller may move upward by the pick-up roller moving device and thus be spaced apart from the medium placed on the support plate while the medium stacked on the support plate is picked up.

In this specification, the support plate, the pick-up roller unit, the detection unit, and the pick-up roller moving device may be commonly called a medium pick-up apparatus.

Also, the financial device may comprise a user interface, a customer information acquisition unit, and a medium processing apparatus. The medium processing apparatus may be understood as a concept in which the medium processing apparatus comprises the medium pick-up apparatus.

Also, the medium processing apparatus may comprise a medium depositing and withdrawing unit, a detection unit for detecting a medium that is deposited or withdrawn, and a medium storage box for storing the deposited medium or the medium to be withdrawn.

In the above-described embodiment, although a structure in which the medium is picked up within the medium storage box, the above-described structure may be equally applied to the medium depositing and withdrawing unit or a temporary stacking part.

In the foregoing embodiment, when the predetermined number of first or second medium are withdrawn from the medium storage box, the pick-up roller unit may move by the pick-up roller moving device. If the first or second medium does not exist on the first or second support plate in the state where the predetermined number of first or second medium are withdrawn, even though the predetermined number of first or second medium are withdrawn, the pick-up roller moving device may not operate.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium pick-up apparatus comprising:

a support plate to support one or more media;

a pick-up roller unit comprising a pick-up roller for picking up the one or more media;

a feed roller to transfer the media that are picked up;

a detection unit to detect number of medium that is picked up by the pick-up roller;

a pick-up roller moving device to move the pick-up roller unit and comprising a first power transfer device to transfer power transmitted from the feed roller to the pickup roller moving unit; and a second power transfer device to transfer the power transmitted from the feed roller to the pick-up roller, wherein, when the detection unit detects that a predetermined number of media are picked up from the one or more media on the support plate, an operation of the pick-up roller is stopped and the pick-up roller moving device moves the pick-up roller unit to be spaced apart from any remaining media supported by the support plate; and wherein the movement of the pick-up roller unit by the pick-up roller moving device and the operation of the pick-up roller are stopped at substantially the same time.

2. The medium pick-up apparatus of claim 1, wherein, when the pick-up roller picks up the one or more media, the pick-up roller passes through the support plate in a state in which the pick-up roller is disposed under the support plate to contact the one or more media that are supported by the support plate.

3. The medium pick-up apparatus of claim 1, wherein in a state in which the detection unit detects that a predetermined number of media are picked up and when the one or more media are not disposed on the support plate, the pick-up roller moving device is maintained in a stopped state.

4. The medium pick-up apparatus of claim 3, further comprising a position fixing unit to fix a moving position of the pick-up roller unit, wherein, when the media are disposed on the support plate in the state in which the pick-up of the predetermined number of medium is detected by the detection unit, the pick-up roller unit fixed by the position fixing unit is released from the fixed position, and the pick-up roller unit moves in a direction away from the support plate.

5. The medium pick-up apparatus of claim 1, wherein, when the pick-up roller picks up the media, the pick-up roller contacts the media supported by the support plate in a state in which the pick-up roller is disposed above the support plate.

6. The medium pick-up apparatus of claim 5, further comprising a position fixing unit to fix a moving position of the pick-up roller unit when the detection unit detects that a predetermined number of media are picked up and the pick-up roller unit moves.

7. The medium pick-up apparatus of claim 1, wherein the support plate comprises:

a first support plate to support a first media; and a second support plate to support a second media, wherein the pick-up roller is disposed between the first support plate and the second support plate, and when the detection unit detects that a predetermined number of media of one of the first and second media, the pick-up roller unit moves toward a support plate on which the other media are stored.

8. The medium pick-up apparatus of claim 7, wherein the detection unit comprises:

a first detection unit to detect number of first media; and a second detection unit to detect number of second media, wherein the first detection unit detects that a predetermined number of the first media are picked up, the pick-up roller unit moves toward the second support plate.

9. The medium pick-up apparatus of claim 8, wherein the pick-up roller unit further comprises a position fixing unit to fix a position of the pick-up roller unit in a state in which the pick-up roller unit moves toward the second support plate.

10. The medium pick-up apparatus of claim 9, wherein, when the second detection unit detects that a predetermined number of the first media are picked up, the pick-up roller unit is released from a position fixed by the position fixing unit, and the pick-up roller unit moves toward the first support plate.

11. The medium pick-up apparatus of claim 1, wherein the pick-up unit comprises:

a connection member connected to a rotation shaft of the pick-up roller; and a hook part provided on the connection member, wherein the pick-up roller moving device moves the hook part.

12. The medium pick-up apparatus of claim 11, wherein the first power transfer device comprises:

a clutch to receive the power transmitted from the feed roller; and a power transmission connected to the clutch to transmit the received power to the hook part.

13. The medium pick-up apparatus of claim 12, further comprising:

a feed roller to transfer the media that are picked up; and a rotation shaft connected to the feed roller, wherein the clutch is connected to the rotation shaft of the feed roller.

14. The medium pick-up apparatus of claim 13, wherein the clutch is turned off while a predetermined number of medium are picked up so that a rotation power of the rotation shaft of the feed roller is not transmitted to the power transmission, and when the detection unit detects that the predetermined number of media are picked up, the clutch is turned on to transmit the rotation power of the rotation shaft of the feed roller to the power transmission.

15. A medium processing apparatus comprising:

a medium depositing and withdrawing unit through which media are deposited or withdrawn;

a medium storage box to store the media that are deposited or withdrawn; and a detection unit to detect the media that are deposited or withdrawn, wherein at least one of the medium depositing and withdrawing unit and the medium storage box comprises:

a pick-up roller for picking up the media stacked in a medium storage space;

a feed roller to transfer the media that are picked up;

a feed roller shaft on which the feed roller is mounted;

a pick-up roller moving device to move the pick-up roller and comprising a first power transfer device to transfer power transmitted from the feed roller shaft to the pick-up roller moving unit; and a second power transfer device to transfer the power transmitted from the feed roller to the pick-up roller, wherein, when a predetermined number of media are withdrawn from the medium storage space from the media stored in the medium storage space, an operation of the pick-up roller is stopped and the pick-up roller moving device moves the pick-up roller in a direction away from any remaining media in the medium storage space to prevent the pick-up roller from contacting the remaining media; and wherein the movement of the pick-up roller by the pick-up roller moving device and the operation of the pick-up roller are stopped at substantially the same time.

16. The medium processing apparatus of claim 15, further comprising an additional support plate disposed under the pick-up roller to support the media.

17. The medium processing apparatus of claim 16, wherein, when the detection unit detects that a predetermined number of media are picked up while the media supported by the additional support plate are picked up, the pick-up roller moving device moves the pick-up roller in a direction away from the additional support plate.

18. A financial device comprising:

a customer information acquisition unit to acquire customer information;

a user interface to display a menu or information for depositing or withdrawing, the user interface inputting or selecting a command or information for depositing or withdrawing; and a medium processing apparatus that stores a medium deposited by a customer and withdraws stored medium for the customer, wherein, when the medium processing apparatus picks up a predetermined number of media among media stacked in a medium storage space by a pick-up roller to withdraw the picked media from the medium storage space, an operation of the pick-up roller is stopped and the pick-up roller is spaced apart from any remaining media of the media stacked in the medium storage space to prevent the pick-up roller from contacting the remaining media after the predetermined number of media are withdrawn from the medium storage space; and wherein the pick-up roller being spaced apart from any remaining media of the media and the operation of the pick-up roller are stopped at substantially the same time, wherein the medium processing apparatus comprises:

a feed roller to transfer the media that are picked up;

a feed roller shaft on which the feed roller is mounted;

a pick-up roller moving device to move the pick-up roller and comprising a first power transfer device to transfer power transmitted from the feed roller shaft to the pick-up roller moving unit; and a second power transfer device to transfer the power transmitted from the feed roller to the pick-up roller.

19. The financial device of claim 18, wherein the medium processing apparatus comprises:

a support plate to support the medium;

the pick-up roller passing through the support plate in a state in which the pick-up roller is disposed under the support plate to pick up the medium supported by the support plate.

* * * * *